United States Patent [19]

Cloward

[11] 4,398,707

[45] Aug. 16, 1983

[54] SURGICAL SADDLE

[76] Inventor: Ralph B. Cloward, 1111 Bishop St., Suite 510, Honolulu, Hi. 96813

[21] Appl. No.: 302,803

[22] Filed: Sep. 16, 1981

[51] Int. Cl.[3] ..... A61G 13/00

[52] U.S. Cl. ..... 269/328

[58] Field of Search ..... 269/328, 42, 111, 119, 269/121; 128/84 R, 134; 5/437, 460

[56] References Cited

U.S. PATENT DOCUMENTS

| | | | |
|---|---|---|---|
| 648,621 | 5/1900 | Hooper | 128/134 |
| 776,943 | 12/1904 | Rice | 269/42 |
| 2,475,003 | 7/1949 | Black | 269/328 |
| 2,521,530 | 9/1950 | McGuffage | 5/431 |
| 2,562,725 | 7/1951 | Leto et al. | 5/431 |
| 2,764,150 | 9/1956 | Ettinger et al. | 269/328 |
| 3,042,025 | 7/1962 | Jackson | 5/431 |

*Primary Examiner*—Robert C. Watson

*Attorney, Agent, or Firm*—Lyon & Lyon

[57] ABSTRACT

An apparatus for positioning, supporting and cushioning a patient during a spinal operation comprising a base pad attachable to a standard operating table and a pair of ridges extending thereabove. The distance between the ridges is adjustable to fit a wide range of patient sizes. The void space between the ridges allows the patient's abdomen and diaphragm to hang freely without compression against the spine thereby eliminating interspinal venous engorgement. The apparatus also properly positions the patient so that the spine is in a flexed state.

13 Claims, 4 Drawing Figures

SURGICAL SADDLE

BACKGROUND

The apparatus of this invention is designed to support, position and cushion the patient during spinal surgery.

Present standard operating procedure for spinal operations calls for placing the patient face-down in a horizontal position on a flat surgical table top. In this position, the patient's greatest weight is supported primarily by the abdomen on the flat table top. Further, the knees are straight and the legs extended.

This creates two problems with which the spinal surgeon must contend and which have an adverse, complicating effect upon the surgical procedure, thereby injecting unnecessary variables. First, of key importance in any operation is the control and minimization of blood loss. Not only does excessive loss of blood during an operation pose an immediate risk of harm to the patient, due either to the loss of blood itself or the risk of hepatitis infection concommitant with any blood transfusion, but excessive bleeding at the operation site also obscures the operatory field hindering the ability of the surgeon to see his work area clearly.

Blood loss during a spinal surgical operation is a function of the degree of intraspinal venous engorgement; that is, whether the blood vessels in the spinal area are full and under pressure, or drained. If the patient is positioned face down on the operating table (as in the standard operating procedure) the abdominal area supports a large portion of the patient's weight. This in turn causes the viscera to be forced against the spinal column. This causes intraspinal engorgement as the blood in the spinal area is retained there and the blood in the visceral area is forced into the spinal area. This situation is exacerberated for the obese patient with a a pendulent abdomen.

Second, when the patient is lying face down on the surgical table with his knees straight and his legs extended, the spinal column is under a compressive load. For any operation on the spine, the surgeon would prefer to have the spine in a flexed position; that is, in a relaxed state under no load. One previous attempt has been made to achieve this result. This entailed placing the patient on his knees in an upright fetal position wherein the patient's knees were pulled forward to his chest. This did flex the spine, but the patient was placed into a very uncomfortable position wherein free breathing was restricted. Also, the viscera was forced against the spinal column so that blood loss was accelerated.

SUMMARY OF INVENTION

The present invention provides a surgical saddle for use primarily during spinal operations wherein the proper positioning of the patient is obtained to flex the spine and simultaneously to eliminate intraspinal venous engorgement. The saddle is designed to be attached to a standard operating table (such as AMSCO-Surgical 2080). The saddle has a base pad of soft material such as foam rubber. Straps extend through channels in the base pad to secure the base pad to the surgical table. At roughly the midpoint of the base pad, a pair of ridges are attached to and extend above the base pad. The ridges are constructed of a more durable material able to support the weight of the patient. The ridges are aligned with one another but are spaced apart. In preparing for the operation, the ridges are adjusted such that one of the iliac crests of the patient rest upon each ridge, thereby giving firm support to the pelvis. The void space between the ridges allows the abdominal viscera to hang free and dependent. Venous blood gravitates into the viscera, lowering intraspinal vascular engorgement which minimizes bleeding.

A large oval aperture is formed in the base pad between the ridges. One end of the aperture is held stationary by straps attached to the table. A strong adjustable strap is attached to the table at one end and at the other end to the base pad at the end of the aperture. Shortening this strap distends the length of the aperture in the pad, lessening the distance between the ridges.

The leg end of the saddle is flexible so that it will fit the surgical table in a position which allows the patient to rest on his knees. This not only flexes the spine, but also allows the physical pounding associated with certain spinal operations to be transmitted in part to the knees and legs.

The upper half of the saddle is made of a very soft material to permit respiratory chest excursion and to diminish pressure on the breasts and face of the patient.

DETAILED DESCRIPTION OF THE PREFERRED EMBODIMENT

Figure 3:
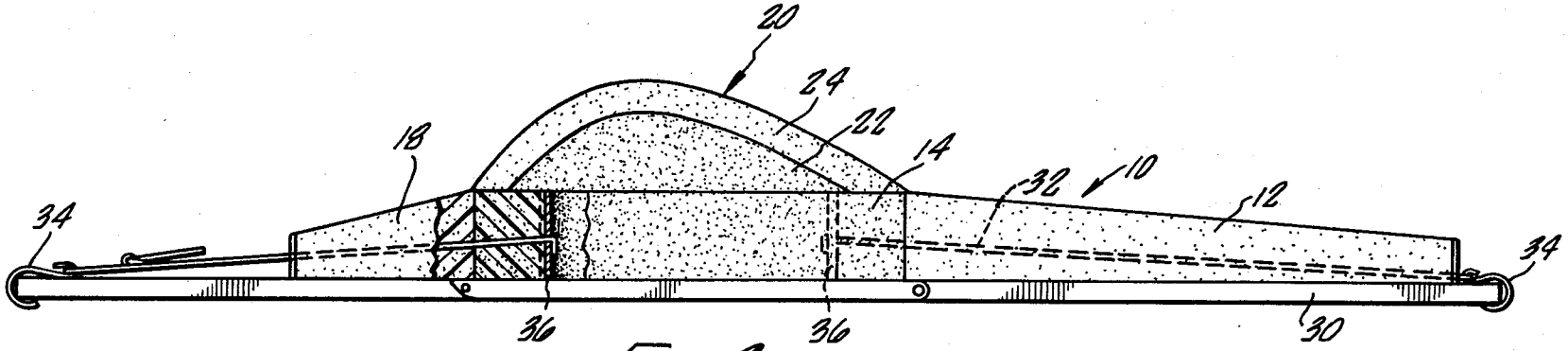
FIG. 3 is a side view of the saddle, in partial cross section, showing the interior strapping as well as the configuration of the ridges and the different density material used in construction.
Figure 4:
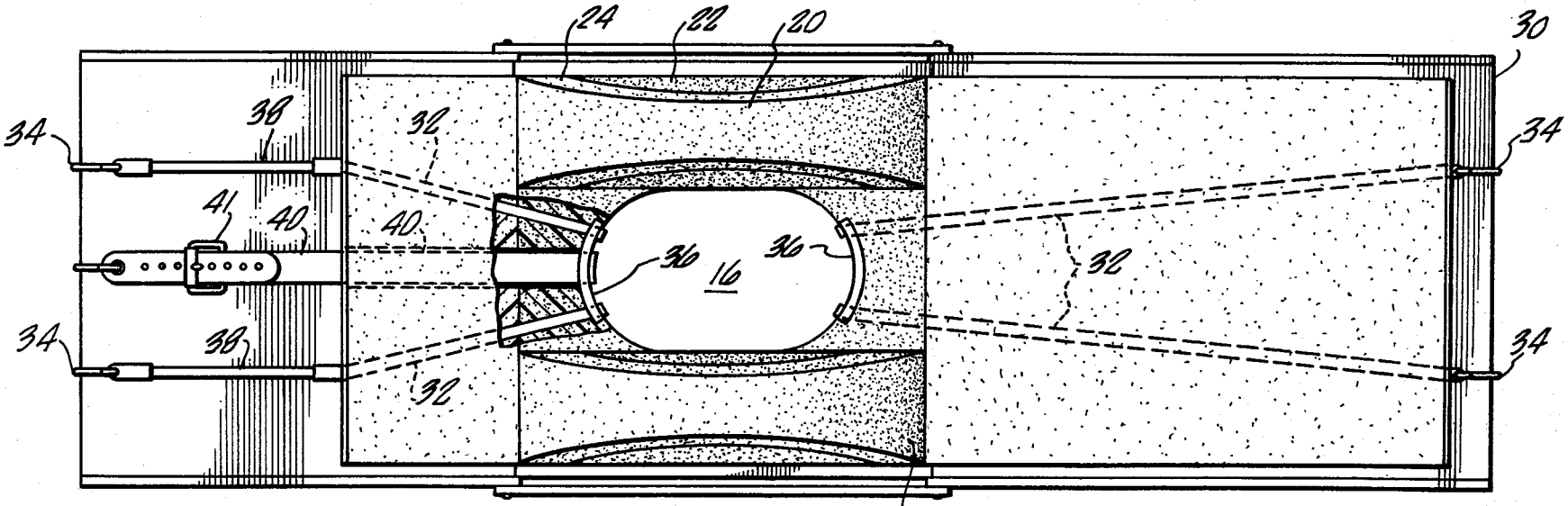
FIG. 4 is a plan view of the saddle showing the adjustment strapping and the oval aperature between the ridges.

The surgical saddle of this invention has a base pad 10 made of a soft material, preferably soft foam rubber. Foam #1644 has been found to be preferable. The base pad may be of unitized construction, although it has been found less expensive from a materials standpoint to construct the base pad from three separate pieces of foam. The first section is the head portion 12 of the saddle. The head portion 12 is constructed of a very soft material, preferably soft foam (#1644). The main function of the head portion 12 of the surgical saddle is to permit respiratory chest excursion, and to provide cushioning to diminish pressure on the breasts and face of the patient. Accordingly, any very soft material will be satisfactory. As can be seen in FIG. 3, the depth of head portion 12 tapers slightly to a minimum at the head portion of the base pad 10. Preferably, the head portion 12 of the base pad 10 should be 22 inches long, 18 inches wide and 4 inches thick tapering to 2 inches thick at its distal end.

The next section of the base pad 10 is center portion 14. Center portion 14 will support a substantial portion of the patient's weight. Accordingly, center portion 14 should be of substantially firmer foam, preferably #2149. Center portion 14 has therein a centrally located oval aperture 16. Preferred dimensions for center portion 14 are 20 inches long, 18 inches wide and 4 inches thick. The oval aperature hole 16 has dimensions 12 inches long by 7 inches wide, or a radius of 3½ inches. The longitudinal axis of the oval aperature 16 is aligned with the longitudinal axis of the surgical saddle.

The third or leg portion 18 of the surgical saddle is also constructed of soft foam. Preferably, its dimensions are 8 inches long, 8 inches wide and 4 inches thick, tapering to 2 inches thick at its distal end. The portions 12, 14 and 18 may be attached in any conventional means, such as glue or other adhesive. It is also possible not to attach the various portions of the base pad 10 as the entire surgical saddle may be enclosed within a removable cover which will retain the various portions in position relative to one another. The cover should be of a heavy, flexible vinyl plastic material, waterproof and tight fitting.

Figure 1:
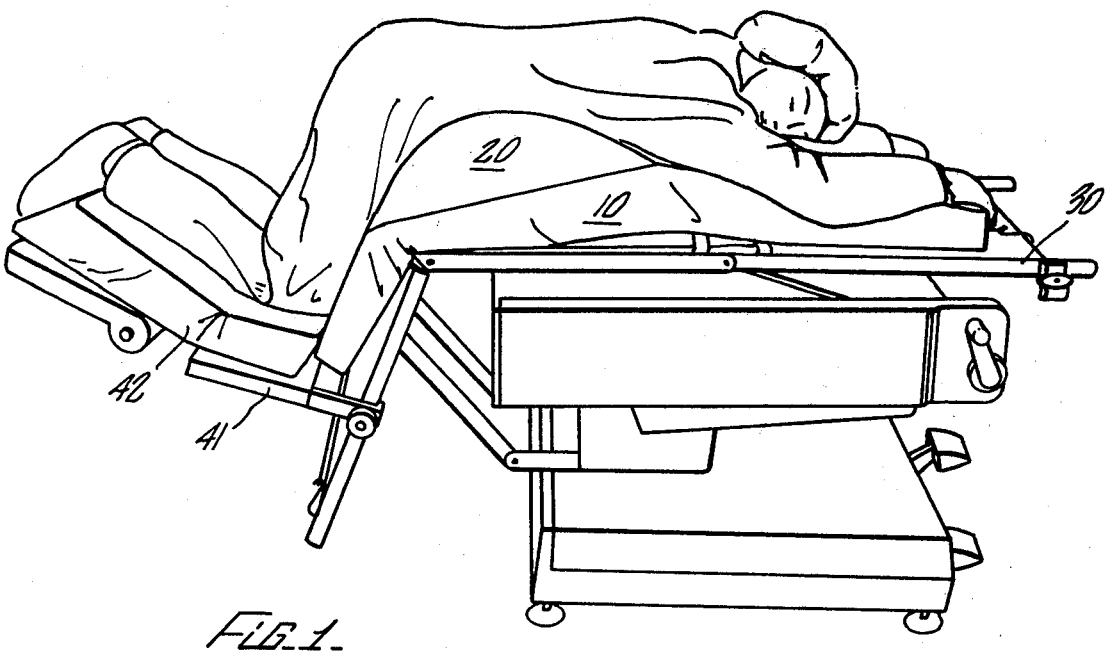
FIG. 1 is a side view of the surgical saddle of the present invention as attached to the surgical table. A patient is shown in operating position in the saddle.
Figure 2:
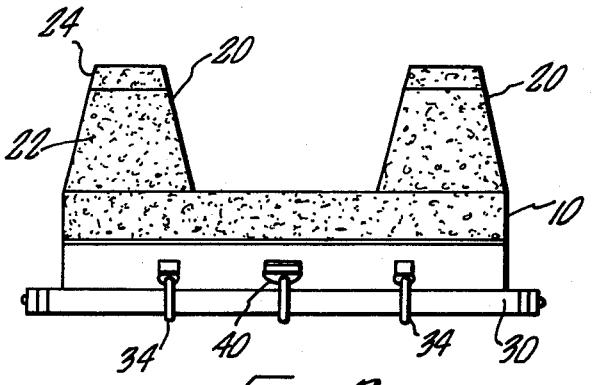
FIG. 2 is a cross section of the saddle showing the base pad and the ridges extending thereabove, as well as the retention and adjustment straps as they are attached to the surgical table.

Attached to the center portion 14 are a pair of ridges 20. Ridges 20 support iliac crests of the pelvic bone of the patient. Accordingly, as the ridges must support a substantial portion of the weight of the patient, they must be of a firm material capable of supporting that weight. In the preferred embodiment, the ridges are of a two piece construction, having an interior portion 22 of hard foam material (#2149) and an outer layer 24 of soft foam material (#1644) for cushioning. As seen in FIG. 3, the ridges 20 are, in longitudinal cross section, rounded. At their greatest elevation, the ridges rise approximately seven and one-half inches above center portion 14. In the latitudinal cross section, shown in FIG. 2, the ridges 20 taper from a base width of approximately five and one half inches to a minimum width of approximately three inches. The ridges 20 are aligned with and abut either side of the oval aperature 16. The purpose of the oval aperature 16 and its position relative to the ridges 20 will be explained infra. As with the various portions of the base pad 10, the ridges 20 may be attached to center portion 14 by any conventional means, or may be retained in place by virtue of the saddle cover.

As shown in the figures, the surgical saddle is attached to a standard American Sterilizer Company operating table (AMSCO-Surgic 2080), given reference numeral 30. The surgical saddle is attached to the operating table 30 by a system of straps. Retention straps 32 have hooks 34 which attach to the edges of the surgical table 30. The various portions of the base pad 10 are channeled so that the straps 32 travel through the interior of the base pad 10. Fronting the interior ends of the oval aperature 16 in center portion 14 are heavy leather supports 36. The retention straps 32 are attached thereto. At one end of the surgical saddle, shown in the preferred embodiment at the leg end of the saddle, the straps 32 have a heavy elastic portion 38. It will be noted that the retention straps 32 exit from the base pad 10 near the corners thereof to preclude the corners of the base pad 10 from curling during the operation.

As patients come in different sizes and shapes, the distance between the iliac crests of the patients may vary substantially. To insure proper positioning of the patient on the saddle, the ridges 20 must be spaced apart such that the iliac crests of the patient rest firmly thereon. Accordingly, the distance between the ridges must be variable. That variability is provided in the preferred embodiment by means of the oval aperature 16, and adjustment strap 40. In the preferred embodiment, the adjustment strap 40 is a heavy leather strap having buckle 41. The strap 40 is attached at one end to surgical table 30. It should be noted that the adjustment strap 40 must be attached to the same end as the elastic portion 38 of the retention straps 32. The other end of the adjustment strap 40 is attached to the heavy leather support 36 at the proximate end of oval aperature 16. It will be appreciated that by shortening the length of adjustment strap 40, the center portion 14 of base pad 10 will be lengthened, causing oval aperature 16 to lengthen. Concommitantly with the lengthening of oval aperature 16, the width of oval aperature 16 will be decreased, thereby pulling the ridges 20 closer together. Loosening the adjustment strap 40 will cause the center portion 14 to spring back to its original shape, increasing the distance between the ridges 20.

To use the surgical saddle of this invention, the base pad 10 is first attached to the surgical table 30 by means of retention straps 32 and hooks 34. The distance between the iliac crests of the patient's pelvic bone is measured. Adjustment strap 40 is shortened or lengthened until ridges 20 are properly spaced correspondingly. The surgical table is then adjusted such that the leg portion of the table is lowered. The knee rest portion 41 of the table is adjusted to fit the leg length of the patient. A knee pad 42 is placed on the knee rest. The patient is manuevered onto the pad such that his abdomen and diaphragm hang freely without compression against the spinal area. The patient's weight is then supported by the ridges 20 and the knee pad 42. This knee-flex position allows the lower spine region to be in an uncompressed, relaxed state more amenable to surgical procedures. Also, because the abdomen and diaphragm are not compressed, but hang freely between the ridges 20, the venous blood in the spinal area will gravitate to the abdominal viscera and therefore there is no engorgement of the intraspinal blood vessels. Accordingly, the use of this invention properly positions the patient for spinal operations and also greatly minimizes the loss of blood during the operation.

While embodiments of the invention have been shown and described, it would be apparent to those skilled in the art that many modifications of these embodiments are possible without departing from the scope of the invention. Accordingly, the invention is not to be limited by the detailed description of the preferred embodiment, but is of the full scope of the appended claims.

I claim:

1. A surgical saddle, attachable to a standard operating table, upon which the patient to be operated upon will be positioned, comprising a base pad; means for securing said base pad to the operating table; a pair of ridges attached to said base pad, said ridges positioned longitudinally along said base pad, substantially aligned but separated from one another, and extending an equal distance above and perpendicular to said base pad; and means for adjusting the distance between said ridges, said means comprising an aperture in said base pad located between said ridges, and means for adjusting the relative length and width of said aperture such that as the length of said aperture is increased, said width is decreased, thereby pulling said ridges closer together.

2. A surgical saddle, attachable to a standard operating table, upon which the patient to be operated upon will be positioned, comprising a base pad; means for securing said base pad to the operating table; a pair of ridges attached to said base pad, said ridges positioned longitudinally along said base pad, substantially aligned but separated from one another, and extending an equal distance above and perpendicular to said base pad; and means for adjusting the distance between said ridges, said means comprising an aperture in said base pad located between said ridges, and means for adjusting the relative length and width of said aperture, said means comprising means for holding said base pad stationary at one end of said aperture relative to the operating table and means for pulling the base pad longitudinally at the opposite end of said aperture and holding said base pad in such extended position, causing the longitudinal length of the aperture to be greater and the width of the aperture to be less, concomitantly pulling the ridges closer together.

3. The surgical saddle of claim 2 wherein the means for holding the base pad stationary at one end of said aperture comprises a larger support piece lining said aperture and straps attached at their first end thereto and at their second end to the operating table.

4. The surgical saddle of claim 3 wherein said straps extend from said support piece through channels formed in said base pad.

5. The surgical saddle of claim 4 wherein said straps emerge from said base pad near the corners thereof.

6. The surgical saddle of claim 2 wherein said means for pulling the base pad longitudinally at the opposite end of said aperture and holding the base pad in the extended position comprises a second support piece lining said opposite end of said aperture and a strap, whose overall length is adjustable, attached at its first end to said support piece and at its second end to the surgical table.

7. The surgical saddle of claims 2, 5 or 6 wherein said aperture is oval in shape and is equal in width to the distance between said ridges and is greater in length than one half the length of said ridges.

8. The surgical saddle of claim 2 wherein said means for securing the base pad to the operating table comprises a plurality of retention straps extending through channels in said base pad and attached at one end to said base pad and at a second end to said operating table.

9. The surgical saddle of claim 8 wherein said retention straps emerge from said base pad at or near the corners thereof.

10. The surgical saddle of claim 9 wherein the retention straps which hook to one end of the operating table are elastic.

11. The surgical saddle of claim 2 where said ridges have a two part construction comprises a central core of firm, weight bearing material, and an outer layer of softer, cushioning material.

12. The surgical saddle of claim 2 wherein said ridge are positioned apart from one another such that the iliac crests of the patient rest upon the ridges.

13. The surgical saddle of claim 2 wherein said ridges have a rounded configuration in longitudinal cross section, gently rising from the base pad to a peak height and gently descending to be level again with the base pad.

* * * * *